US005327117A

United States Patent [19]

Kohsaka

[11] Patent Number: 5,327,117

[45] Date of Patent: Jul. 5, 1994

[54] ADAPTIVE MESSAGE DISPLAY APPARATUS

[75] Inventor: Masatsune Kohsaka, Kyota, Japan

[73] Assignee: Omron Corporation, Kyoto, Japan

[21] Appl. No.: 855,914

[22] Filed: Mar. 23, 1992

[30] Foreign Application Priority Data

Mar. 22, 1991 [JP] Japan ..... 3-059099

[51] Int. Cl.[5] ..... G08B 25/00

[52] U.S. Cl. ..... 340/525; 340/459; 340/461; 340/691; 340/519

[58] Field of Search ..... 340/525, 459, 461, 462, 340/519-524, 691

[56] References Cited

U.S. PATENT DOCUMENTS

| | | | |
|---|---|---|---|
| 4,072,924 | 2/1978 | Pomerantz | 340/461 |
| 4,816,208 | 3/1989 | Woods et al. | 340/525 |
| 5,006,829 | 4/1991 | Miyamoto et al. | 340/459 |
| 5,121,112 | 6/1992 | Nakadozono | 340/459 |

*Primary Examiner*—Donnie L. Crosland

*Attorney, Agent, or Firm*—Dickstein, Shapiro & Morin

[57] ABSTRACT

Sensors are used to detect data representing the current state of at least one monitored phenomena. The time available for a human being to make a judgment concerning the detected phenomena is determined and an appropriate number of messages corresponding to the current state of the monitored phenomena is determined for output. At the same time, the priority of each of the messages to be displayed is determined. The number of messages deemed to be appropriate are output and displayed in the order of priority.

17 Claims, 8 Drawing Sheets

FIG. 2
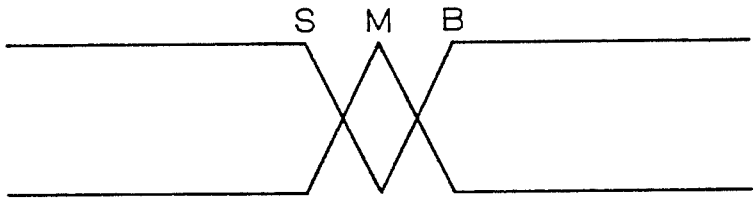
FIG. 3
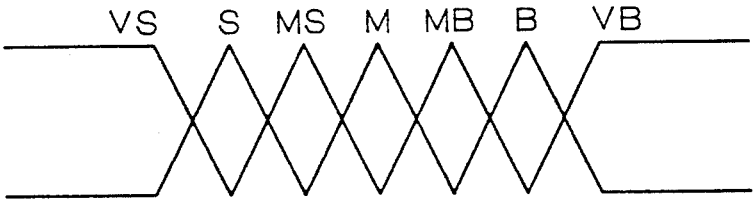
FIG. 4
| | |
|---|---|
| 1 | BE CAREFUL OF ONCOMING TRAFFIC |
| 2 | DANGER OF SKIDDING |
| 3 | PULL OVER |
| 4 | |
| | |
| R | |

FIG. 10 (A)

SPEED S

| AMOUNT OF TRAFFIC \ RATE OF INCREASE OF TRAFFIC | S | MS | M | ML | L |
|---|---|---|---|---|---|
| S | L | L | ML | M | MS |
| MS | L | ML | M | MS | S |
| M | L | ML | M | MS | S |
| ML | ML | M | MS | S | S |
| L | ML | M | MS | S | S |

FIG. 10 (B)

SPEED MS

| AMOUNT OF TRAFFIC \ RATE OF INCREASE OF TRAFFIC | S | MS | M | ML | L |
|---|---|---|---|---|---|
| S | L | L | L | ML | M |
| MS | L | L | ML | M | MS |
| M | L | L | ML | M | MS |
| ML | L | ML | M | MS | S |
| L | L | ML | M | MS | S |

FIG. 10 (C)

SPEED L

| AMOUNT OF TRAFFIC \ RATE OF INCREASE OF TRAFFIC | S | MS | M | ML | L |
|---|---|---|---|---|---|
| S | L | L | L | L | ML |
| MS | L | L | L | L | ML |
| M | L | L | L | ML | M |
| ML | L | L | L | ML | M |
| L | L | L | ML | M | MS |

FIG. 11 (A)

| LOCATION | SPEED |
|---|---|
| --- | --- |
| --- | --- |

| ENTRANCE | AMOUNT OF TRAFFIC |
|---|---|
| --- | --- |
| --- | --- |
| --- | --- |

1992-1-4-SAT, 9:50

FIG. 11 (B)

| LOCATION | SPEED | ENTRANCE | AMOUNT OF TRAFFIC |
|---|---|---|---|
| | | | |
| | | | |
| | | | |
| | | | |
| | | | |
| | | | |
| | | | |

1992-1-4-SAT, 7:55

ADAPTIVE MESSAGE DISPLAY APPARATUS

FIELD OF THE INVENTION

This invention relates to an output device for displaying messages in response to a variety of data. It might, for example, output an optimal set of display messages to a driver based on such data as road condition, speed, driver's pulse rate and so forth; or it might output an optimal set of display messages for a given situation to a person in a stationary location based on such data as traffic congestion, speed of vehicles, and so forth. The term "messages" as used herein refers to any type of message capable of sensory perception by a human, visual or audible messages being two common examples.

DISCUSSION OF EXISTING TECHNOLOGY

As the number of cars on the road has increased in recent years, data display devices have been developed for displaying messages concerning traffic on highways and ordinary streets. These data displays serve to inform drivers of the amount of congestion they are likely to encounter on a given road. One example of such a traffic data display device is described in Japanese Patent Publication No. 58-35318.

The traffic data displays referred to above merely display the condition of the road. They do not display messages according to the importance of each displayable item of information to an individual driver. Let us approach this problem from the standpoint of traffic safety. If, for example, a given road is slippery, there is little distance between vehicles, and vehicles are travelling at high speed, we would like the display to direct the driver to urgently reduce his speed. However, if the vehicles are travelling at low speed on a slippery road, it would be sufficient for the display to direct the driver simply to be careful of skidding. In some cases, the data obtained from these types of judgments point to the necessity of quickly outputting a display while in other cases time is not a critical factor.

This situation is not limited to automobiles. In nuclear power plants, too, some of the various problems which occur must be addressed immediately, while others are not as urgent.

SUMMARY OF THE INVENTION

In light of the above, one object of this invention is to provide an output device which can determine the optimal form of a message display according to data obtained from one or a set of phenomena being monitored.

In order that it may accomplish the objective set out above, the output device of this invention is equipped with a means to sense data which outputs the current state of one or more phenomena under consideration based on data obtained from one or more sensors; means for determining the priority ranking of each of a plurality of display elements based on the current state obtained from the sensors; means for calculating from the current state obtained from the sensors the time allowance within which a human being must make a judgment based on the current state; and means for determining the form of the display according to the priority ranking created by the means for determining the same and the time allowance calculated by the calculation means.

The output device of this invention determines the priority ranking of each display element from the current state of one or a plurality of actual phenomena based on the data detected by sensors. It then calculates the time allowance within which a human being must make a judgment concerning the sensed phenomena. It determines what elements will be displayed according to the priority ranking it has produced. The device then determines the form the display will take according to the display elements chosen and the time allowance calculated. In this way the output device can determine the optimal form of display in response to data gathered about pertinent phenomena.

The above objects, advantages and features of the invention will be more readily understood from the following detailed description of the invention which is provided in connection with the accompanying drawings.

BRIEF DESCRIPTION OF THE DRAWINGS

FIG. 2 shows membership functions on the antecedent for the fuzzy logic in FIG. 1;

FIG. 3 shows membership functions on the consequent for the fuzzy logic in FIG. 1;

FIG. 4 shows an example of the form in which messages may be stored in the message memory shown in FIG. 1;

FIGS. 10(A), 10(B) and 10(C) show examples of fuzzy rules; and

FIGS. 11(A) and 11(B) show examples of the appearance of the display.

DETAILED DESCRIPTION OF THE INVENTION

Figure 1:
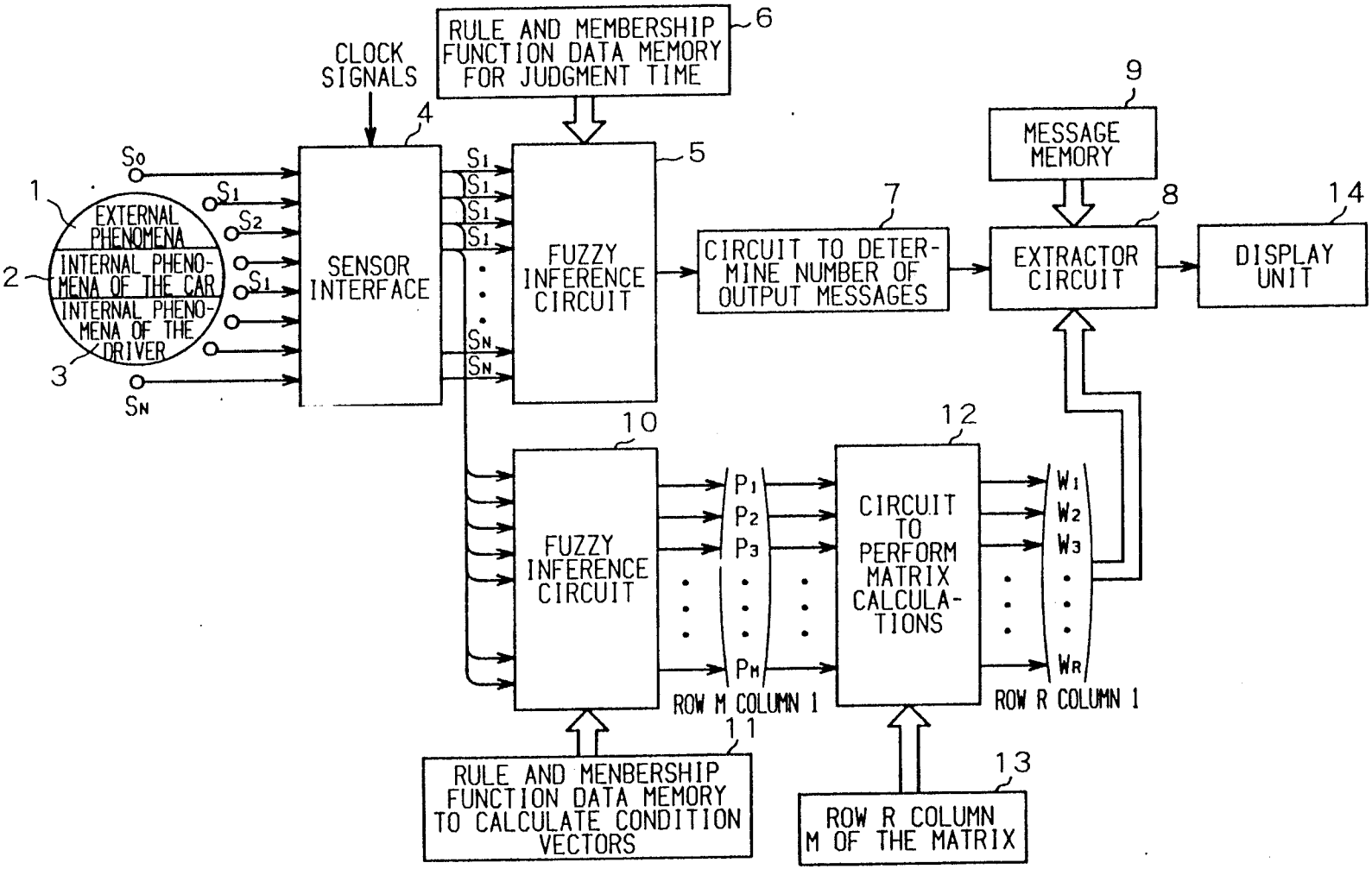
FIG. 1 is a block diagram showing the essential parts of the first embodiment of the invention.

FIG. 1 is a block diagram showing the essential parts of the first embodiment of the invention. As can be seen in the diagram, this embodiment divides the phenomena to be interpreted into three classes. In this example, the phenomena concern the driving of a car. Type 1 phenomena are those of the external world: the condition of the road surface, the interval between vehicles, and so on. Type 2 phenomena are those internal to the car: its speed, steering angle, and so on. Type 3 phenomena are those internal to the driver: his pulse rate and blood pressure, the concentration of alcohol in his blood, and so on. Data concerning phenomena of types 1 through 3 are detected by sensors S1, . . . , Si, . . . , SN. The output of these detectors is sent to sensor interface 4. Interface 4 transmits the differential output of sensors S1, . . . , Si, . . . , and SN to fuzzy inference circuits 5 and 10 in response to clock signals. We might say, then, that the sensing device consists of sensors S1, . . . , Si, . . . , and SN together with sensor interface 4. The sensing device uses the current data concerning all phenomena of types 1 through 3, such as condition of road surface, speed and driver's pulse rate, etc., to output the current state of the monitored phenomena. The situation is output as "Road is slippery," "Driving at high speed," "Pulse is racing," and so on.

Fuzzy inference circuit 5 performs fuzzy inferences to determine how much time the driver has to make a judgment based on the current state of the monitored parameters. It transmits the upper limit on the time allowed for making a judgment to circuit 7, which determines the number of messages to be output. The device to calculate time allowance consists of fuzzy inference circuit 5 and rule and membership function data memory 6. Circuit 7 determines the number of messages m which can be output without exceeding the upper limit of the judgment time which has been inferred, and transmits this finding to extractor circuit 8. Message memory 9 is preferably a ROM containing a plurality of prestored messages. An appropriate selection of messages is chosen from the previously stored cache of messages in message memory 9, which is connected to extractor circuit 8. The content of these messages is stored in the form of individual display elements (messages) selected ahead of time, such as "Be careful of oncoming traffic"or "Danger of skidding" (See FIG. 4). By designating message addresses, circuit 8 can extract the specified number of appropriate messages.

Fuzzy inference circuit 10 uses the current state, which is the collection of physical measurements transmitted by sensor interface 4, to perform fuzzy inferences based on rule and membership function stored in data memory 11. The condition vectors (P1, P2, . . . , and PM), which are values for the physical judgments arrived at by the inference, are transmitted to matrix calculation circuit 12. These condition vectors would include, for example, reckless driving, which is inferred from rate of acceleration and steering angle, and danger of skidding, inferred from steering angle and temperature of road surface.

Matrix calculation circuit 12 calculates a matrix from the aforesaid condition vectors, which have one column and M rows, and matrix 13, which has R rows and M columns. It determines the priority ranking of the R messages which are to be displayed, and it assigns each a weight. The weighted priority data W1, W2, . . . , and WR are transmitted to extractor circuit 8. More specifically, priority datum W1 is obtained by the linear equation given below.

$$W1 = P1 \cdot Z11 + P2 \cdot Z12 + \ldots + Pm \cdot Z1m$$

The other priority data W2, W3, . . . , and WR are obtained in the same fashion. The matrix 13 is a parameter matrix consisting of the values for the parameter Z, which serve to define the linear relationship between vector P and vector W.

The priority data W1, W2, . . . , and WR correspond to the individual messages stored in message memory 9. For example, priority datum W1 indicates the priority ranking of the first message stored in the memory, "Be careful of oncoming traffic." Priority datum W2 indicates the priority ranking of the second message stored in the memory, "Danger of skidding." Together, fuzzy inference circuit 10, rule and membership function data memory 11, matrix calculation circuit 12 and matrix 13 comprise a means for determining priority ranking.

Extractor circuit 8 uses the priority data W1, W2, . . . , and WR which it receives from matrix calculation circuit 12 to determine which elements are to be displayed, i.e., which messages are to be displayed. It does so by choosing the messages with the highest priority data. In this example, circuit 8 extracts m number of messages from those with the highest priority data based on the number of messages m which it has received from circuit 7, the circuit which determines that number. Circuit 8 then determines the form of the display, transmits the messages to display 14, and causes them to be displayed. Extractor circuit 8 constitutes the means for determining the form of the display. The messages may be displayed one at a time in order of diminishing priority; they may be displayed simultaneously, with the size of the letters adjusted according to the number of messages to be displayed, as described in Japanese Patent Publication No. 58-35318; or a means may be provided whereby the user can select either one continuous display or successive displays. Another form of display which can be used to attract the driver's attention is graphics only or a combination of graphics and text.

FIG. 2 shows the membership functions on antecedent, and FIG. 3 those on consequent used in the fuzzy inference circuit 10. We shall next explain the operation of the first embodiment described above with reference to FIGS. 1 through 4. Let us assume that among the sensors S1, . . . , Si, . . . , and SN, sensor S1 detects the temperature of the road; sensor S2 detects the interval between this car and the vehicles ahead of and behind it; sensor S3 detects the speed of the car; sensor S4 detects the steering angle of the steering wheel; and sensor S5 detects the driver's pulse rate. The data detected by sensors S1 through S5 are sent to fuzzy inference circuit 5 by way of sensor interface 4. Fuzzy inference circuit 5 uses the output of sensors S1 through S5 to perform fuzzy inferences according to the rule and membership function data memory 6 pictured in FIG. 2. The letter B in FIG. 2 indicates that the output is big, the letter M that it is medium, and the letter S that it is small.

For example, let us assume that the car is travelling at high speed, the steering angle is large and the interval between this car and the preceding and following cars is small. If the driver continues with the current course of action, there is a significant chance that a collision will occur. Judgment time $T_0$, the time the driver has to decide what to do next, such as step on the brake, and execute this decision, is very small (VS). This can be expressed by the following fuzzy rule.

Formula 1: If S3=B & S4=B & S2=S Then $T_0$=VS

If the car is travelling at high speed and the angle of steering is large, but the interval between cars is large, the judgment time will be small (S). We can express this by the following fuzzy rule.

Formula 2: If S3=B & S4=B & S2=B Then $T_0$=S

If the car is travelling at medium speed, the steering angle is medium, and the interval between cars is medium, the judgment time will be medium (M). This can be expressed by the following fuzzy rule.

Formula 3: If S3=M & S4=M & S2=M Then $T_0$=M

If the car is travelling at medium speed, the steering angle is small, and the interval between cars is small, the judgment time will be relatively long (MB: Medium Big). This can be expressed by the following fuzzy rule.

Formula 4: If S3=M & S4=S & S2=S Then $T_0$=MB

If the temperature of the road surface is low, the steering angle is large and the driver's pulse rate is high, the judgment time $T_0$ will be short. Expressed as a fuzzy rule, this becomes the following.

Formula 5: If S1=S & S4=B & S5=B Then $T_0$=S

Fuzzy inference device 10 calculates the condition vectors according to the sensor output it receives from sensor interface 4. If, for example, the car is travelling at high speed, the steering angle is large, the temperature of the road surface is low and the interval between cars is small, the probability of reckless driving (P1) is large (VB). This is expressed by the following fuzzy rule.

Formula 6: If S3=B & S4=B & [(S1=S)+(S2=S)] then P1=B

If the car is travelling at high speed and the steering angle is medium, the probability of reckless driving is medium. This is expressed by the following fuzzy rule.

Formula 7: If S3=B & S4=M Then P1=M

If the car is travelling at low speed, the steering angle is large, the temperature of the road surface is low and the interval between cars is small, the probability of reckless driving is small. This is expressed by the following fuzzy rule.

Formula 8: If S3=S & S4=B & [(S1=S)+(S2=S)] Then P1=S

If the steering angle is large and the temperature of the road surface is low, the danger of skidding (P2) is high. This is expressed by the following fuzzy rule.

Formula 9: If S4=B & S1=S Then P2=B

If the steering angle is small and the temperature of the road surface is high, the danger of skidding is very low. This is expressed by the following fuzzy rule.

Formula 10: If S4=S & S1=B Then P2=VS

If the steering angle is large, the interval between cars is small and the driver's pulse rate is low, the probability of falling asleep at the wheel (P3) is large. This is expressed by the following fuzzy rule.

Formula 11: If S4=B & S2=S & S5=S Then P3=B

If the steering angle is large and the driver's pulse rate is low, the probability of falling asleep at the wheel is relatively large. This may be expressed as the following fuzzy rule.

Formula 12: If S4=B & S5=S Then P3=MB

If the steering angle is medium, the interval between cars is small and the driver's pulse rate is medium, the probability of falling asleep at the wheel is relatively large. This may be expressed as the following fuzzy rule.

Formula 13: If S4=M & S2=S & S5=M Then P3=MB

As has been stated above, the condition vector, which has one column and M rows, is calculated by fuzzy inference circuit 10 and transmitted to matrix calculation circuit 12. Circuit 12 calculates a matrix from the condition vectors it has received, which have one column and M rows, and matrix 13, which has R rows and M columns. It determines the priority of the R messages to be displayed and transmits the priority data W1, W2, . . . , and WR for each column in row R to extractor circuit 8. Extractor circuit 8 extracts m number of data from message memory 9 in order of priority, transmits them to display 14 and displays them. The messages may be displayed graphically on display 14 or they may be communicated audibly, e.g., by voice.

Figure 5:
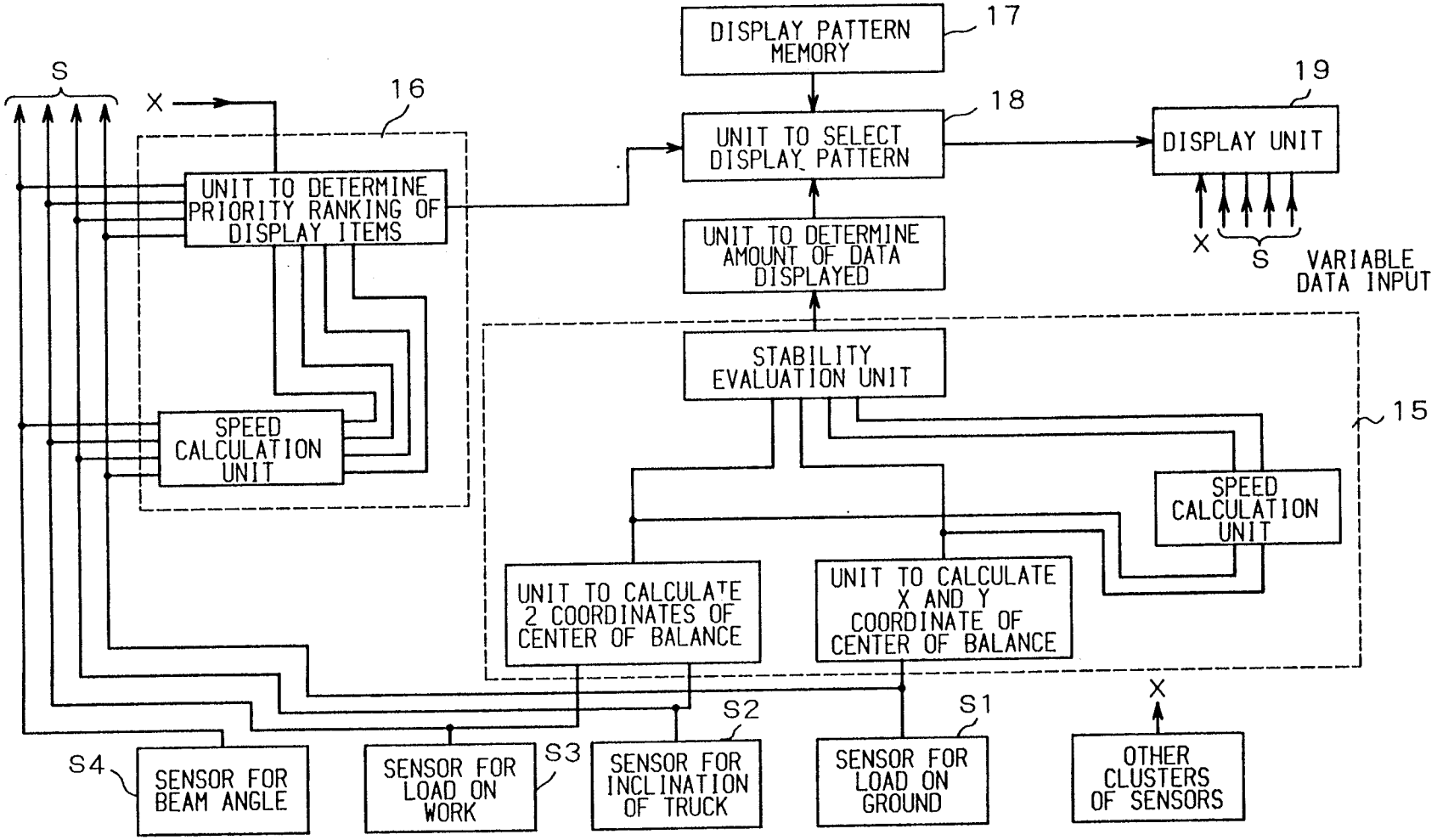
FIG. 5 is a block diagram showing the essential parts of the second embodiment of the invention.

FIGS. 5, 6A, 6B illustrate the second embodiment of the output device relating to this invention. This embodiment differs from the previous one in that it performs its various control tasks without resorting to fuzzy inference. The specific way in which it is constructed is as discussed below. The device in this example is to be applied as an output device to display on an instrument panel the operational state of a variety of industrial machines. If, for example, power equipment such as a crane is used to lift a work piece and by rotating a beam move the work piece into a specified position, display 19 would show the operating state of the crane, its balance, and so on. In order to display this information, sensors S1 through S4 must detect the current state by gathering various data, including: the load on the bottom of the truck which constitutes the body of the crane and on other established points (S1); the angle of inclination of the truck (S2); the load of the work (S3); and the angle of the beam from which the work is suspended (S4).

Once the current state has been detected, the output of sensor S1 is transmitted to the unit which calculates the X and Y coordinates of the center of balance, and the output of sensors S2 and S3 is transmitted to the unit which calculates the Z coordinates of the center of balance. In this way the location of the crane's center of balance is obtained for the horizontal plane (X and Y) as well as for the vertical direction (Z). Each location of center of balance which is obtained is transmitted, either as is or by way of the speed calculation unit, to the stability evaluation unit. A first derivative is performed in the speed calculation unit, and the variance of each value is obtained. The stability of the crane is obtained from all the location data for center of balance and from the derivatized data. The stability is calculated by sorting the many input variables into different spaces and assigning each space an output value. In other words, the calculation is performed with reference to a table which was created and stored previously. In this example, the stability is evaluated in a number of stages. If the stability is low, there is a high probability that the crane will overturn, and the operator urgently needs to correct the balance. In other words, there is very little time for the human being to make a judgment. The coordinate calculation units, speed calculation unit and stability evaluation unit constitute the means to calculate the time allowance (15).

The stability value which has been obtained is transmitted to the unit which determines how much information to display, where the number of messages to be displayed is determined. The lower the stability, the fewer messages will be displayed. The result which has been calculated is transmitted to selection unit 18, where the displayed messages are chosen.

The outputs of sensors S1 and S4 are each transmitted to the speed calculation device and the unit to determine the priority ranking of the displayable items, which together constitute the means to determine priority ranking (16). The speed calculation device performs a first derivative as described above, and the result of the derivative operation is sent to the unit to determine the priority ranking of the displayable items. This priority determination unit uses the same type of space assignment system as the aforesaid stability evaluation unit to obtain the priority data for each message (or display element) stored in display pattern memory 17. The results of its calculations are sent to selection unit 18, which chooses the display pattern.

Figure 6:
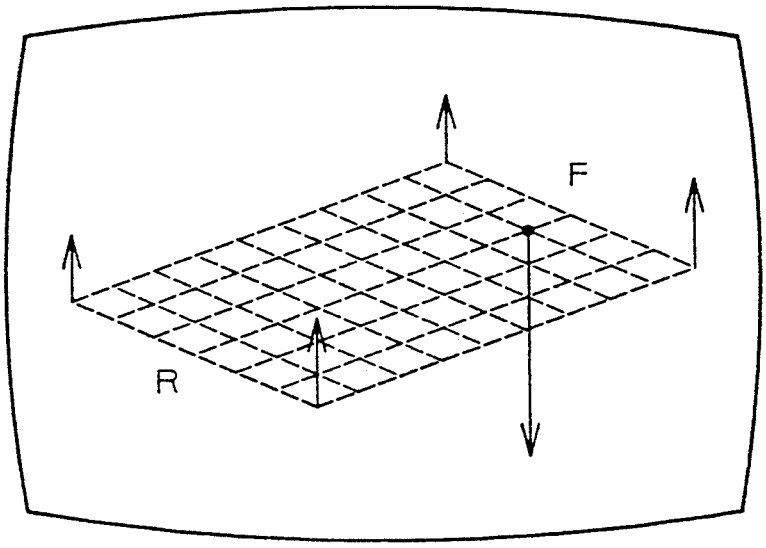
FIGS. 6(A) and 6(b) show examples of the appearance of the display.
Figure 6:
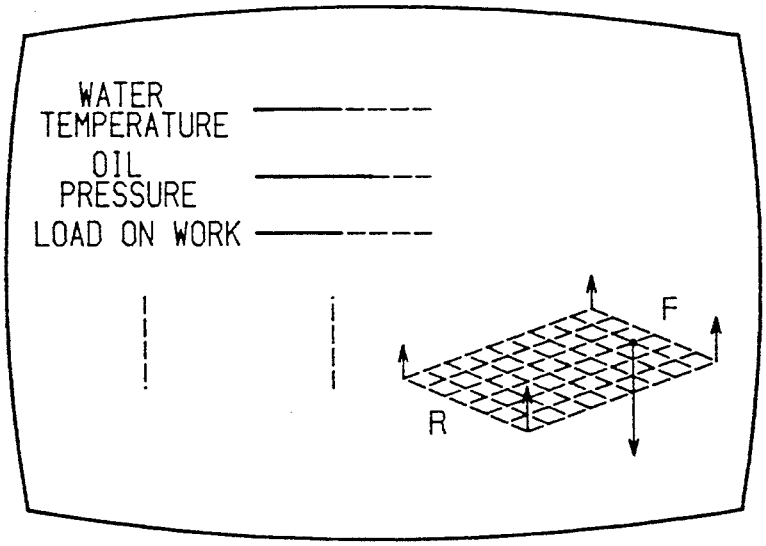

Display pattern selection unit 18 functions in the same way as selector circuit 8 in the first embodiment which was described earlier. The unit to determine amount of data to be displayed decides how many display elements can be shown and sends them, in order of descending priority, to display unit 19. Display unit 19 is capable of displaying graphics and text simultaneously. It synthesizes the fixed data (titles, framework, and so on) stored in display pattern memory 17 and the variable data X and S sent from each of the sensors and displays the result. An example is shown in FIG. 6 (A) of a case in which the stability is low and there is little time to make a decision. Only the state of the crane's balance is shown, and it is rendered in the form of a graphic. This form of display is chosen in order to enable the operator to decide quickly in which direction the center of balance should be shifted so as to prevent the crane from overturning. An example is shown in FIG. 6 (B) of a case in which the stability is high and there is a relatively large block of time available to make a decision. In addition to displaying the aforesaid graphic of the state of the crane's balance, the unit will display the current data gathered by the aforesaid sensors S1 through S4 as well as various aspects of the operating state of the crane which have been detected by other clusters of sensors, such as those for water temperature or oil pressure.

The fixed data stored in the aforesaid display pattern memory 17 include such titles in the figures as "Water Temperature," "Oil Pressure," or "Load on Work," and the basic graphic elements (in this example, the parts other than the arrows indicating the vectors).

Figure 7:
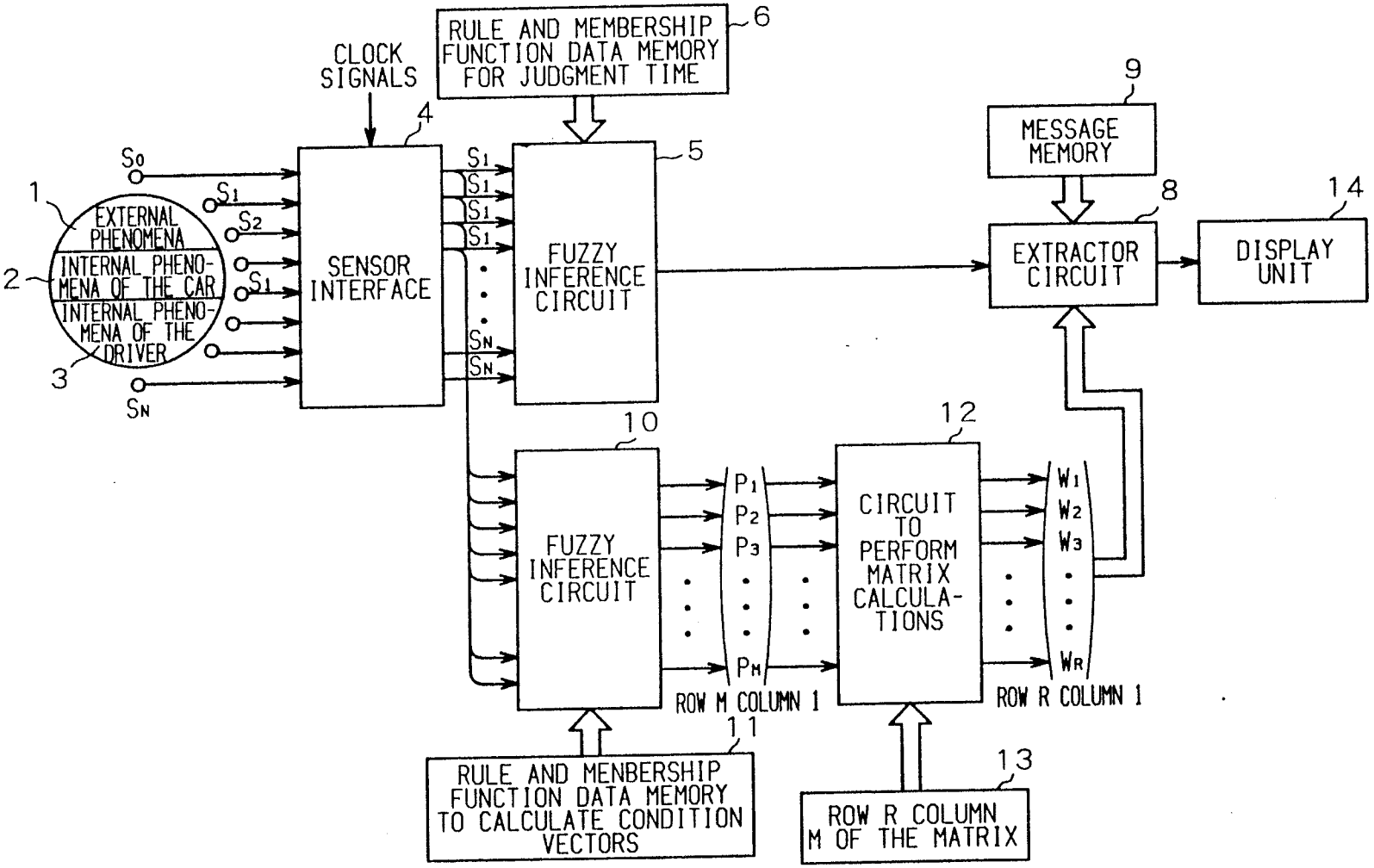
FIG. 7 is a block diagram showing the essential parts of the third embodiment of the invention.

A third embodiment relating of this invention is shown in FIG. 7. In the first two embodiments discussed above, the devices served to output various messages to the driver or equipment operator based on data obtained from the monitored phenomena. In the third embodiment, we provide an example of a device which outputs the optimal display elements or items to a control base in another location based on data such as traffic congestion, vehicular speed, etc. More specifically, it might output display elements to help determine whether or not to close a highway entrance in response to the state of congestion of the highway. The overall structure of the device needed to perform such a task is the same as that described in the first embodiment given above. The specific functions of the various devices differ from those of the first embodiment as detailed below.

In this example, sensors S1, . . . , Si, . . . , and SN detect the amount of traffic at various points on the highway, the increase in amount of traffic and the average speed of the vehicles at each point. However, if one or more vehicles are going excessively fast, their speeds are excluded when the average is computed.

Figure 8:
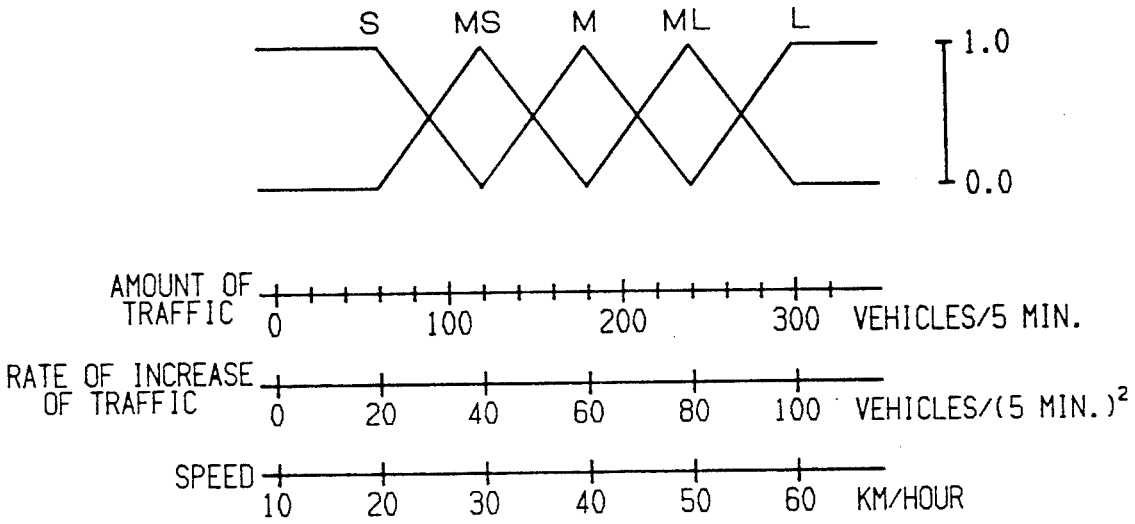
FIG. 8 shows the input membership functions for the fuzzy logic in FIG. 7.
Figure 9:
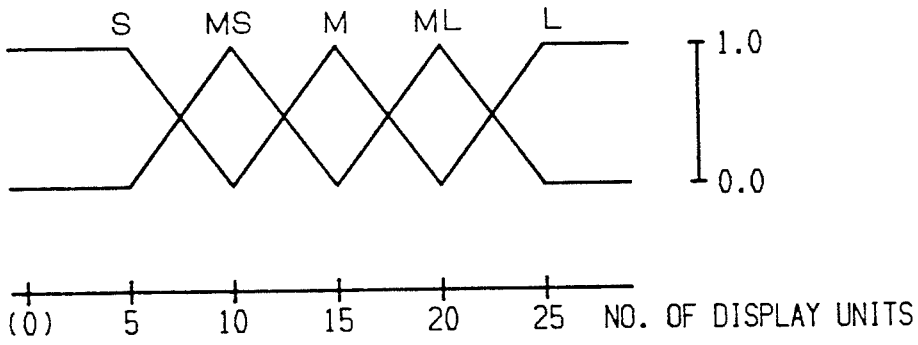
FIG. 9 shows the output membership functions for the fuzzy logic in FIG. 7.

The various data for amount of traffic and the other parameters mentioned above are transmitted along with the location data which have been gathered to fuzzy inference circuit 5 by way of sensor interface 4. The antecedent membership functions at this point are shown in FIG. 8, and the consequent membership functions in FIG. 9. Fuzzy inference circuit 5 performs fuzzy inferences based on the antecedent conditions which it has been given, in accordance with membership functions 6 shown in FIGS. 10A–10C. Circuit 5 obtains the number of items to be displayed and transmits this number to extractor circuit 8. Some examples of rules are given below.

If the speed of the vehicles is relatively low (30 km per hour=MS), the amount of traffic is relatively large (240 vehicles in 5 minutes=ML) and the rate of increase in traffic is medium (60 vehicles/(5 minutes)$^2$=M), there is no urgent need to close the entrance, but there is a probability that the traffic will back up in the near future. In this case the number of items to be displayed will be M medium: (15 items).

If the speed of the vehicles is low (15 km per hour=S), the amount of traffic is large (310 vehicles in 5 minutes =L) and the rate of increase in traffic is relatively high (80 vehicles/(5 minutes)$^2$=MH), the judgment can be made that traffic is backed up. The specified entrance should immediately be closed in order to reduce the number of vehicles on the highway. In this case the number of items to be displayed will be S small: (5 items) so that a judgment can be made quickly.

If the speed of the vehicles is high (60 km per hour=H), the amount of traffic is small (40 vehicles in 5 minutes =S) and the rate of increase in traffic is also small (20 vehicles/(5 minutes)$^2$=S), the judgment can be made that traffic is not backed up at present. The situation is not urgent, and it is necessary to observe the state of traffic over a wide area in order to determine which areas are liable to experience backups in the future. In this case, the number of items to be displayed will be L (large: 25 items).

The current state, as expressed by the data gathered by the sensors S1, . . . , Si, . . . and SN, is transmitted to fuzzy inference circuit 10. Just as in the first embodiment described above, circuit 10 performs fuzzy inferences and performs the calculations necessary to create a matrix. It obtains the priority data W1, W2, . . . , and WR for each detection area and transmits these data to extractor circuit 8. The priority ranking of the data is virtually directly proportional to the existence of a backup, so each rank will be virtually equivalent to one of the membership functions to determine the number of display items. However, topographic features such as curves in the road or a poor road surface may cause there to be locations where backups are likely to occur even though traffic is relatively light; conversely, there may be areas where congestion seldom occurs even though traffic is heavy and the rate of increase is high. These situations differ in which points must be given careful attention before a decision is made. What facts are relevant may vary with the season or the time of day, so it may be desirable to modify the appropriate membership values.

Extractor circuit 8 extracts the specified number of elements from message memory 9, which as noted above is preferably a ROM, containing pre-stored messages, in order of decreasing priority and sends them to display unit 14. Examples of the form of the display produced by display unit 14 are shown in FIGS. 11A and 11B. The display shows the speed of the vehicles in the detection area, the closest entrance before the congested area (name of entrance), and other similar information. FIG. 11 (A) shows the type of display used when the situation is urgent, and FIG. 11 (B) that used when the situation is relatively benign.

To give a specific example of how the number of display items is determined, let us consider a case in which the traffic is severely congested. The detectors report a number of points where the vehicle speed is low. Fuzzy inferences are performed based on the current state at each of these points to determine the number of display items for each point, and the actual number of items which will be displayed is determined by averaging the individual numbers.

In the embodiments described above, examples are provided of devices in which both number of items to be displayed and order of priority are obtained. However, this invention is not limited to this use only, but can be used to perform one or the other of these tasks exclusively. It would, for example, be permissible for fuzzy inference circuit 10, rule and membership function data memory 11, matrix calculation circuit 12 and matrix 13 to be eliminated, so that the only task performed would be the determination of number of display items from the various data. In this case, the messages stored in message memory 9 would have a fixed priority ranking established ahead of time. It would be equally permissible to eliminate fuzzy inference circuit 5, rule and membership function data memory 6 and circuit 7 to determine number of output messages, so that only the order of priority would be determined from the various data. In this case, the number of messages to be displayed would be determined ahead of time.

As was described above, the display device to which this invention has a means of sensing data which outputs the current state of one or more phenomena based on data concerning these phenomena which were gathered by sensing devices; a priority ranking for each of a set of messages is determined based on this current state; the time available for a human being to make a judgment is calculated; the message elements to be displayed are determined in accordance with the priority ranking assigned; and the form of the display is chosen with regard to which units will be displayed and how much time is available, so that the optimal form for the display can be determined.

This invention is not limited to the applications suggested in the examples given. It could also be used for such tasks as monitoring a number of control states in a nuclear power plant or similar facility and displaying the required data. It can, in other words, be used for many and various applications.

It should thus be apparent that many modifications can be made to the invention as described above without departing from the spirit and scope of the invention. Accordingly, the invention is not limited by the foregoing description, but is only limited by the scope of the appended claims.

I claim:

1. A message display apparatus comprising:

at least one sensor which outputs data representing a current state of at least one monitored phenomenon;

first means, responsive to an output of said at least one sensor, for determining one or more display elements corresponding to a sensed state of said at least one monitored phenomenon and for determining a priority ranking of each display element corresponding to the sensed state of said at least one phenomenon;

second means, responsive to the output of said at least one sensor, for calculating a time allowance within which a human being must make a judgment regarding the sensed state of said at least one monitored phenomenon; and third means responsive to outputs of said first and second means for establishing a form of a display.

2. A message display apparatus as in claim 1, wherein said third means selects which display elements from said first means are to be displayed based on the priority ranking determined for each display element by said first means.

3. A message display apparatus as in claim 2, wherein said third means further determines the form of display of those selected display elements based on the selected display elements and the time allowance calculated by said second means.

4. A message display apparatus as in claim 1, further comprising a plurality of sensors which output data representing the current state of at least one monitored phenomenon, said first means being responsive to outputs of said plurality of sensors for determining one or more display elements corresponding to the sensed state of said at least one monitored phenomenon and for determining the priority ranking of each display element corresponding to the sensed state of said at least one monitored phenomenon, said second means being responsive to the outputs of said plurality of sensors for calculating the time allowance within which a human must make a judgment regarding the sensed state of said at least one monitored phenomenon.

5. A message display apparatus as in claim 1, further comprising a plurality of sensors which output data representing the current state of a plurality of monitored phenomenon, said first means being responsive to outputs of said plurality of sensors for determining one or more display elements corresponding to the sensed states of said plurality of monitored phenomenon and for determining the priority ranking of each display element corresponding to the sensed states of said plurality of monitored phenomenon and for determining the priority ranking of each display element corresponding to the sensed state of said plurality of monitored phenomenon, said second means being responsive to the outputs of said plurality of sensors for calculating the time allowance within which a human must make a judgment regarding the sensed states of said plurality of monitored phenomenon.

6. A message display apparatus as in claim 1, wherein said second means comprises inference means for calculating said time allowance using fuzzy inferences based on rule membership functions.

7. A message display apparatus as in claim 1, wherein said first means comprises inference means for determining said one or more display elements and said priority ranking using fuzzy inferences based on rule membership functions.

8. A message display apparatus as in claim 7, further comprising a plurality of sensors which output data representing the current state of at least one monitored phenomenon, said first means being responsive to the outputs of said plurality of sensors in determining said time allowance.

9. A message display apparatus as in claim 7, further comprising a plurality of sensors which output data representing the current states of a plurality of monitored phenomenon, said first means being responsive to the outputs of said plurality of sensors in determining said time allowance.

10. A message display apparatus comprising:

at least one sensor which outputs data representing a current state of at least one monitored phenomenon;

first means, responsive to the output of said at least one sensor, for determining a time allowance within which a human being must make a judgment concerning said at least one monitored phenomenon, said first means comprising inference means which makes fuzzy inferences based on said current state to determine said time allowance;

second means, for calculating a number of messages which can be output within the time allowance determined by said first means; and third means for outputting messages, said third means containing a number of pre-stored messages, said third means including means for outputting a number of said pre-stored messages corresponding to the number of messages calculated by said second means.

11. A message display apparatus as in claim 10, further comprising a plurality of sensors which output data representing the current state of at least one monitored phenomenon, said first means being responsive to the outputs of said plurality of sensors for determining said priority ranking.

12. A message display apparatus as in claim 10, further comprising a plurality of sensors which output data representing the current states of a plurality of monitored phenomenon, said first means being responsive to the outputs of said plurality of sensors for determining said priority ranking.

13. A message display apparatus comprising:

at least one sensor which outputs data representing a current state of at least one monitored phenomenon;

means for storing a plurality of display elements associated with the current state of said at least one monitored phenomenon;

first means, responsive to the output of said at least one sensor, for determining a priority ranking of said display elements, said first means comprising inference means which makes fuzzy inferences based on said current state to decide the ranking of each display element; and second means for determining which of said display elements to display according to the priority ranking determined by said first means.

14. A message display apparatus as in claim 13, further comprising a plurality of sensors which output data representing the current state of at least one monitored phenomenon, said first means being responsive to the outputs of said plurality of sensors in determining said plurality of possible display elements.

15. A message display apparatus as in claim 13, further a plurality of sensors which output data representing the current states of a plurality of monitored phenomenon, said first means being responsive to the outputs of said plurality of sensors in determining said plurality of possible display elements.

16. A message display apparatus as in claim 13, wherein said second means determines that fewer of said possible display items are to be displayed as the urgency of the current state increases.

17. A message display apparatus comprising:

at least one sensor which outputs a current state of at least one monitored phenomenon;

first means responsive to the outputs of said at least one sensor for determining a plurality of possible display elements corresponding to the current state of said at least one monitored phenomenon;

second means, for calculating a number of said possible display items which are to be displayed, said second means comprising inference means which makes fuzzy inferences based on said current state to determine the number of possible display items based on an urgency of the current state; and third means for outputting the number of display elements calculated by said second means.

* * * * *